US011376842B2

(12) United States Patent
Stöckle et al.

(10) Patent No.: US 11,376,842 B2
(45) Date of Patent: Jul. 5, 2022

(54) CONTROLLER AND METHOD FOR ACTIVATING A PRINT HEAD

(71) Applicant: Canon Production Printing Holding B.V., Venlo (NL)

(72) Inventors: Ulrich Stöckle, Munich (DE); Florian Hitzlsperger, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 2 days.

(21) Appl. No.: 17/197,926

(22) Filed: Mar. 10, 2021

(65) Prior Publication Data

US 2021/0283901 A1 Sep. 16, 2021

(30) Foreign Application Priority Data

Mar. 11, 2020 (DE) ..... 102020106587.6

(51) Int. Cl.
*B41J 2/045* (2006.01)
*B41J 11/00* (2006.01)

(52) U.S. Cl.
CPC ..... *B41J 2/04503* (2013.01); *B41J 2/04573* (2013.01); *B41J 11/0095* (2013.01)

(58) Field of Classification Search
CPC ..... B41J 2/04503; B41J 2/04573; B41J 11/0095; B41J 11/008; B41J 2/04548; B41J 2/04555; B41J 2/04521; B41J 2/0457; B41J 2/01; B05C 5/02
See application file for complete search history.

(56) References Cited

U.S. PATENT DOCUMENTS

| | | | | |
|---|---|---|---|---|
| 10,406,840 | B2 | 9/2019 | Zollner et al. | |
| 2018/0244075 | A1* | 8/2018 | Nakagawa | G06K 15/102 |
| 2019/0054739 | A1 | 2/2019 | Yasuda et al. | |
| 2020/0290367 | A1* | 9/2020 | Kawafuji | B41J 29/38 |
| 2020/0324555 | A1* | 10/2020 | Moribe | B41J 2/2054 |

FOREIGN PATENT DOCUMENTS

| | | | |
|---|---|---|---|
| DE | 102016122786 | A1 | 5/2018 |
| DE | 102017114470 | A1 | 1/2019 |

OTHER PUBLICATIONS

German Search Report dated Nov. 9, 2020, Application No. 102020106587.6.

* cited by examiner

*Primary Examiner* — Kristal Feggins
(74) *Attorney, Agent, or Firm* — The Webb Law Firm

(57) ABSTRACT

A controller for operating a print head is described, which controller is designed to shift the activation points in time of the print head for printing of different lines of a print image on a recording medium relative to the line signal points in time, said line signal points in time being dependent on the transport velocity of the recording medium, such that the print head is operated with quantized operating frequencies from a set of predefined quantized operating frequencies. The print quality of the print head may thus be increased.

12 Claims, 2 Drawing Sheets

CONTROLLER AND METHOD FOR ACTIVATING A PRINT HEAD

CROSS REFERENCE TO RELATED APPLICATIONS

This patent application claims priority to German Patent Application No. 10 2020 106 587.6, filed Mar. 11, 2020, which is incorporated herein by reference in its entirety.

BACKGROUND

Field

The disclosure relates to a controller and a method for activating a print head of a printing device, in particular an inkjet printing device.

Related Art

A printing device, in particular an inkjet printing device, for printing to a recording medium may comprise one or more print heads respectively having one or more nozzles. The nozzles are respectively configured to eject ink droplets in order to print dots of a print image onto the recording medium. The one or more print heads and the recording medium are thereby moved relative to one another in order to ink dots onto the recording medium at different positions, in particular in different lines, and in order to thus print a print image onto the recording medium.

The print timing or activating timing to activate a print head may be generated by sampling the movement of the recording medium. The transport velocity of the recording medium may fluctuate, such that the activation timing of the print head may fluctuate to a corresponding extent. These fluctuations of the activation timing may lead to negative effects on the print quality of the printing device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
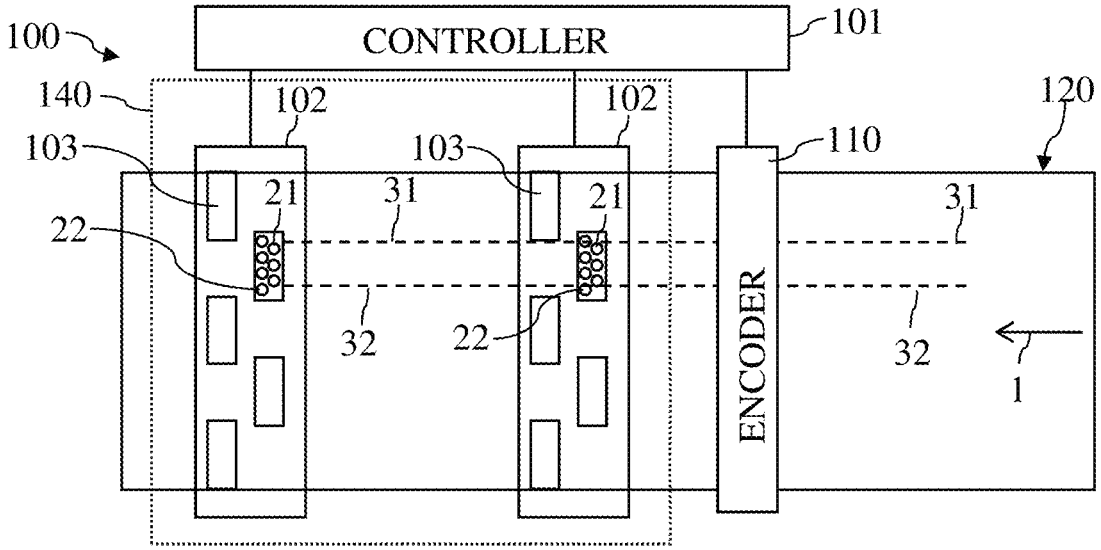

FIG. 1 an inkjet printing device according to an exemplary embodiment of the present disclosure.

Figure 2:
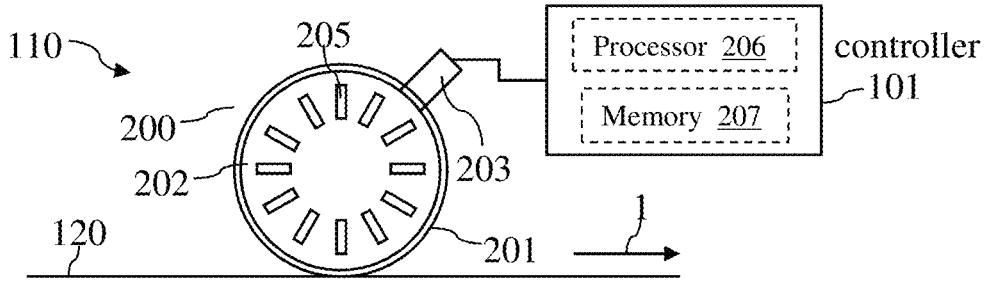

FIG. 2 a transducer for determining a line timing or a line signal according to an exemplary embodiment of the present disclosure.

Figure 3A:
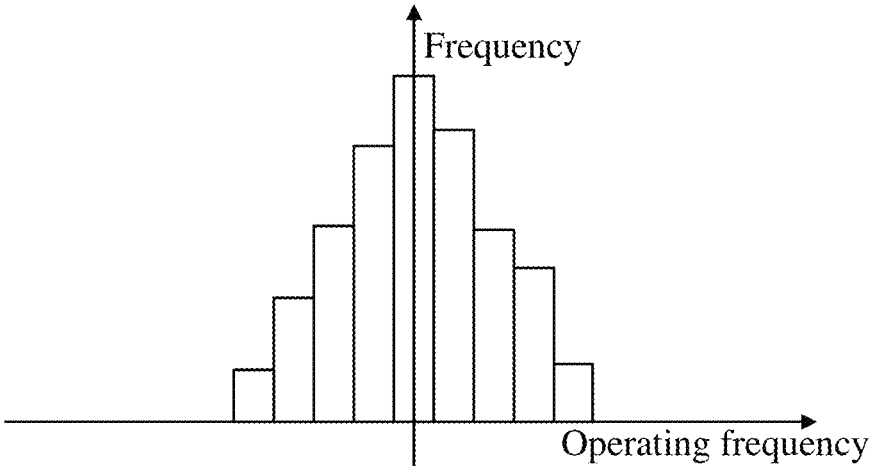

FIG. 3*a* a plot of a frequency distribution of the quantized operating frequencies of a print head according to an exemplary embodiment of the present disclosure.

Figure 3B:
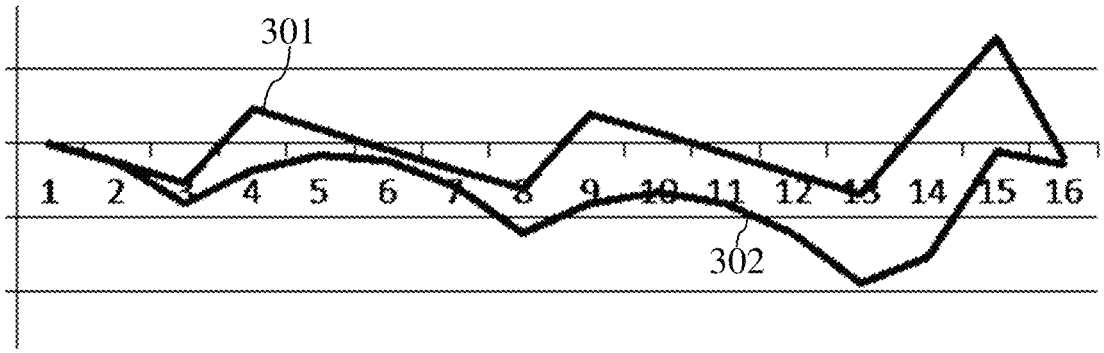

FIG. 3*b* a plot of time curves of the line quantization error and of the accumulated quantization error according to an exemplary embodiment of the present disclosure.

Figure 3C:
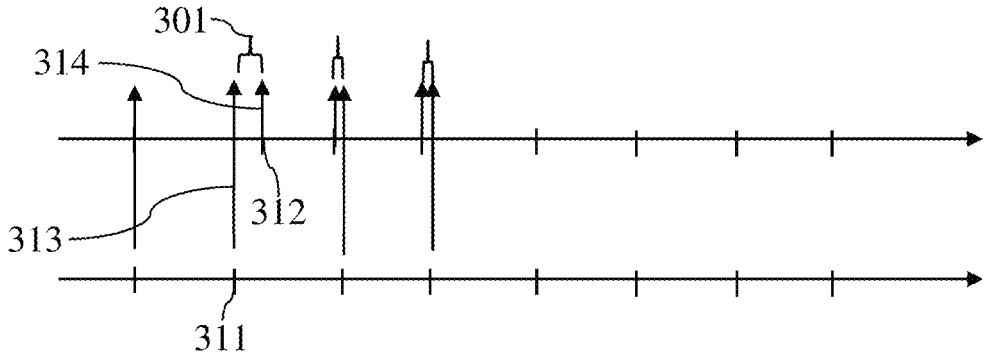

FIG. 3*c* a plot of a shift of the activation signals relative to the line signals, or of the activation points in time relative to the line signal points in time, according to an exemplary embodiment of the present disclosure.

Figure 4:
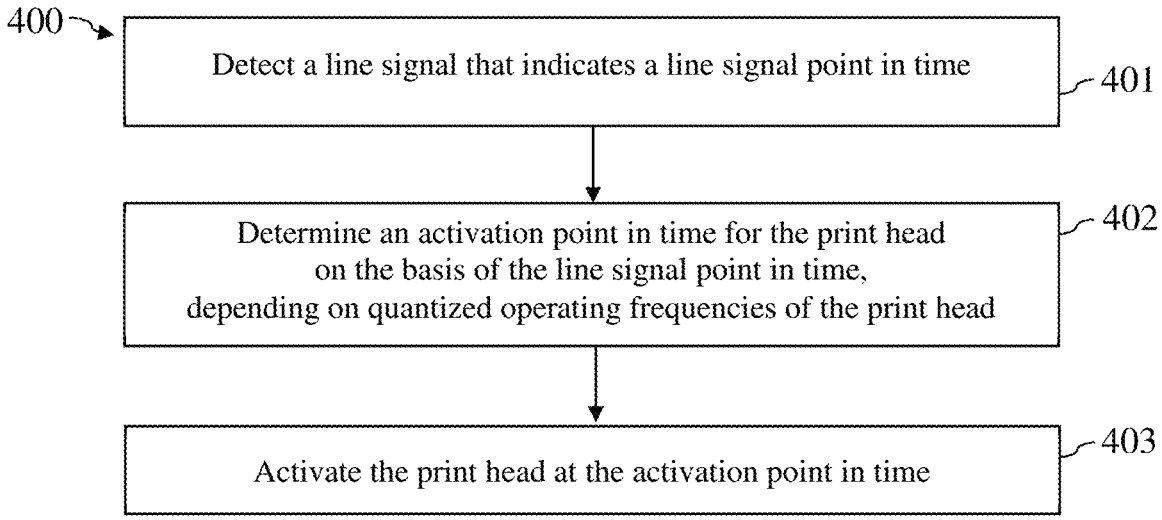

FIG. 4 a flowchart of a method for operating a print head of a printing device according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

The present document deals with the technical object of at least partially or completely compensating for the negative effect on the print quality of a printing device that is caused by variations of the transport velocity of a recording medium.

According to one aspect of the disclosure, a controller is described for a print head of a printing device, wherein the print head is designed to print lines of a print image line by line onto a recording medium. For the printing of a current line, the controller is configured to detect a line signal depending on the transport velocity of the recording medium, wherein the line signal indicates a line signal point in time for printing the current line. The controller is also configured to determine an activation point in time for printing the current line on the basis of the line signal point in time, depending on a set of possible quantized operating frequencies of the print head and depending on an accumulated quantization error produced upon printing of one or more preceding lines. Moreover, the controller is configured to have the effect that the print head prints the current line at the activation point in time, in particular, prints one or more dots of the current line.

According to a further aspect of the disclosure, a method is described for operating a print head that is designed to print lines of a print image line by line onto a recording medium. For the printing of a current line, the method includes the detection of a line signal depending on the transport velocity of the recording medium, which line signal indicates a line signal point in time for printing the current line. The method also includes the determination of an activation point in time for printing the current line on the basis of the line signal point in time, depending on a set of possible quantized operating frequencies of the print head and depending on an accumulated quantization error produced upon printing one or more preceding lines. Furthermore, the method includes the effect that the print head prints the current line at the activation point in time.

The printing device (printer) 100 according to an exemplary embodiment as depicted in FIG. 1*a* is designed for printing to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed through the print group 140 of the printing device 100 along the transport direction 1, which is represented by an arrow.

In the depicted example, the print group 140 of the printing device 100 comprises two print bars 102, wherein each print bar 102 may be used for printing with ink of a defined color, for example black, cyan, magenta, and/or yellow, and if applicable MICR ink. Different print bars 102 may be used for printing with respective different inks. Furthermore, the printing device 100 typically comprises at least one fixer or dryer 150 that is configured to fix and/or to dry a print image printed onto the recording medium 120.

A print bar 102 may comprise one or more print heads 103 that are arranged side by side in a plurality of rows in order to print the dots of different columns 31, 32 of a print image onto the recording medium 120. In the example depicted in FIG. 1, a print bar 102 comprises five print heads 103, wherein each print head 103 prints the dots of a group of columns 31, 32 of a print image onto the recording medium 120. The number of print heads 103 of a print bar 102 may be 5 or more or 10 or more, for example.

In the embodiment depicted in FIG. 1, each print head 103 of the print group 140 comprises a plurality of nozzles 21, 22, wherein each nozzle 21, 22 is configured to fire or eject ink droplets onto the recording medium 120. A print head 103 of the print group 140 may comprise multiple thousands of effectively utilized nozzles 21, 22, for example, that are arranged along a plurality of rows transverse to the transport direction 1 of the recording medium 120. By means of the nozzles 21, 22 of a print head 103 of the print group 150, dots of a line of a print image may be printed onto the recording medium 120 transverse to the transport direction 1, meaning along the width of the recording medium 120.

In an exemplary embodiment, the printing device 100 also comprises a controller 101, for example an activation hardware and/or a processor, that is configured to activate the actuators of the individual nozzles 21, 22 of the individual print heads 103 of the print group 140 in order to apply the print image onto the recording medium 120 depending on print data. In an exemplary embodiment, the controller 101 includes processor circuitry that is configured to perform one or more functions and/or operations of the controller 101, including activating the actuators of the individual nozzles 21, 22 of the individual print heads 103 of the print group 140 based on print data and/or controlling the overall operation of the printing device 100 and/or one or more components therein. In this embodiment, the controller 101 may further include a memory 207 that stores instructions that are executable by one or more processors 206 of the controller 101.

The print group 140 of the printing device 100 thus comprises at least one print bar 102 having K nozzles 21, 22, wherein the nozzles 21, 22 may be arranged in one or more print heads 103, and wherein the nozzles 21, 22 may be activated with a defined line timing or with a defined activation frequency in order to print a line traveling transverse to the transport direction 1 of the recording medium 120 onto the recording medium 120 with K pixels or K columns 31, 32 of a print image, for example with K>1000. In the depicted example, the nozzles 21, 22 are installed immobile or fixed in the printing device 100, and the recording medium 120 is directed past the stationary nozzles 21, 22 with a defined transport velocity.

The printing device 100 also comprises a rotary encoder or transducer 110 that is configured to provide a base timing to determine a line signal for activating the nozzles of the printing device 100. As depicted in FIG. 2, the rotary encoder 110 comprises an encoder roller 201 that is driven by the recording medium 120 moving in the transport direction 1 and that moves with the recording medium 120, typically without slippage. One revolution of the encoder roller 201 thus corresponds to a defined distance d of the recording medium 120, and thus to a defined number of lines of a print image to be printed.

The rotary encoder 110, in particular an incremental encoder, may moreover comprise at least one rotary encoder 200 that, for example, has a disc 202 provided with slits 205 that is arranged between a light emitting diode (not depicted in FIG. 2) and a photodetector 203 so that the light of the light emitting diode through the slits 205 may strike the photodetector 203. At least one timing signal may thus be generated per slit 205, from which the line timing or the line signal may then be generated for a line of a print image that is to be printed, typically as an integer multiple of the timing signals.

By changing the transport velocity of the recording medium 120, a change of the line timing is produced, for example of a frequency of the line signals, which in turn leads to a change of the activation frequency of the one or more print heads 103 of the printing device 100. The transport velocity of the recording medium 120 may, for example, fluctuate around a nominal velocity value, for instance due to a limited control precision, whereby a corresponding fluctuation of the line timing for activating the one or more print heads 103 is produced.

Fluctuations of the line timing, and as a result of this fluctuations of the operating frequency of a print head 103, may have a negative effect on the print quality of the print head 103, since the droplet formation may be degraded at some operating frequencies due to resonance. To increase the print quality, it is therefore advantageous that operating frequencies of the print head 103 at which the droplet formation is degraded be avoided. For this purpose, a set of quantized operating frequencies for a print head 103 may be defined, and during the operation of a printing device 100 it may be produced that the print head 103 is operated exclusively with the quantized operating frequencies from the predefined set of quantized operating frequencies. The quantized operating frequencies may be such that the droplet formation of the print head 104 is not degraded at the individual quantized operating frequencies. The quantized operating frequencies may cover, if possible uniformly cover, a defined range of possible operating frequencies of the print head 103. An example range of possible operating frequencies is 62 kHz to 64 kHz, but is not limited thereto.

The controller 101 of the printing device 100 may be configured to detect a line signal for printing a new and/or current line on the basis of the timing signals of the transducer 110, wherein the line signal indicates that the at least one print head 103 of the printing device 100 should be activated at a line signal point in time in order to print the new and/or current line on the recording medium 120.

Furthermore, in an exemplary embodiment, the controller 101 is configured to determine the line signal operating frequency of the print head 103 that would result if the print head 103 were activated at the line signal point in time. For this purpose, the duration between the activation point in time at which the preceding line was printed and the line signal point in time at which the current line should be printed may be determined. The line signal operating frequency may be calculated on the basis of, in particular as a reciprocal of, the determined duration.

A check may then be performed as to whether the line signal operating frequency corresponds to a quantized operating frequency or not. If this is the case, the print head 103 is activated at the line signal point in time in order to print the current line.

If the line signal operating frequency does not correspond to any quantized operating frequency from the set of quantized operating frequencies, a quantized operating frequency from the set of quantized operating frequencies is selected, for example the quantized operating frequency that is closest to the line signal operating frequency. On the basis of the selected quantized operating frequency, a corrected point in time may then be determined for activation of the print head 103. The corrected point in time, meaning the activation point in time for printing the current line, is thereby determined such that the selected quantized operating frequency for the print head 103 results given activation of the print head 103 at the corrected point in time.

The discrepancy between the line signal operating frequency and the selected, quantized operating frequency, or the discrepancy between the line signal point in time and the corrected point in time, corresponds to a line quantization error for the currently printed line. The line quantization error may be added to an accumulated quantization error, wherein the accumulated quantization error indicates the accumulated line quantization error of the previously printed lines of the print image.

The accumulated quantization error determined upon the printing of the directly preceding line may be taken into account in the quantization of the line signal operating frequency for the printing of the current line. In particular, a quantized operating frequency may thereby be selected from the set of quantized operating frequencies for which the smallest accumulated quantization error results given consideration of the line quantization error of the line signal operating frequency of the current line.

FIG. 3*c* shows an example of a chronological sequence of line signals 313 for a corresponding sequence of line signal points in time $t_z(n)$ 311. Furthermore, FIG. 3*c* shows a sequence determined therefrom of corrected points in time $t_k(n)$ 312 for generating a corresponding sequence of activation or print signals 314 for a print head 103. The parameter "n" thereby indicates the line to be printed. The difference of a corrected point in time $t_k(n)$ 312 and a line signal point in time $t_z(n)$ 311 is the line quantization error $\Delta(n)=t_k(n)-t_z(n)$ 301. The value of the accumulated quantization error given a current line n results as the sum of the line quantization error $\Delta(n)$ of all preceding lines, inclusive of the current line n, of the print image to be printed.

As is to be learned from FIG. 3*c*, the corrected point in time $t_k(n)$ 312 for a portion of the lines n may be chronologically after the line signal point in time $t_z(n)$ 311, such that a positive line quantization error $\Delta(n)$ results. On the other hand, the corrected point in time $t_k(n)$ 312 for a portion of the lines n may be chronologically before the line signal point in time $t_z(n)$ 311, such that a negative line quantization error $\Delta(n)$ results. By chronologically advancing or chronologically delaying the corrected points in time $t_k(n)$ 312, for a sequence of lines n the effect may thus be produced that the accumulated quantization error is kept relatively small, in particular smaller than a quantization error threshold, for example of 0.2 μs. The chronological advancement of a corrected point in time $t_k(n)$ 312 may thereby be enabled by using a time buffer of at least one line timing between the generation of the line signal 312 and the generation of the activation signal 314.

FIG. 3*a* shows an example of a distribution of the frequency of the different quantized operating frequencies of a print head 103. FIG. 3*b* shows an example of a time curve of the line quantization error 301 and of the accumulated quantization error 302. From FIG. 3*b*, it is clear that the accumulated quantization error 302 may be limited via the alternation of the chronological advancement and chronological delaying of the corrected points in time $t_k(n)$ 312, meaning the activation points in time, so that the registration errors that are caused due to the quantization of the operating frequencies of the print head 103 may be ignored upon printing a print image.

To determine the quantized operating frequency given a current line n, the respective resulting line quantization error $\Delta(n)$ 301 and the respective resulting accumulated quantization error 302 may be determined for possible quantized operating frequencies from the set of possible quantized operating frequencies. It is thereby typically sufficient to consider the two quantized operating frequencies from the set of possible quantized operating frequencies that are closest to the line signal operating frequency, wherein a positive line quantization error $\Delta(n)$ 301 is produced by the first quantized operating frequency and wherein a negative line quantization error $\Delta(n)$ 301 is produced by the second quantized operating frequency. The quantized operating frequency may then be selected for which the smallest accumulated quantization error 302 results.

Quantized operating frequencies, and based thereupon corrected points in time $t_k(n)$ 312, meaning activation points in time for activation of the print head 103, may accordingly be determined for a sequence of lines. The effect may thus be produced that ink droplets with high quality may be produced by a print head 103 in each line so that an increased print quality results.

In order to avoid disadvantageous intermediate operating frequencies for a print head 103 without incurring a registration error, the line signal 312 generated by the transducer 110 may thus be quantized in order to have the effect that the print head 103 is operated only with quantized operating frequencies from a set of predefined quantized operating frequencies. The line quantization errors 301 produced by the quantization in a line may be stored, in particular as a portion of the accumulated quantization error 302, in order to offset the quantization error 301, 302 with one or more following lines.

A set of quantized operating frequencies, for example 62 kHz, 62.5 kHz, 63 kHz etc., may thus be defined and stored given which a clean and stable droplet generation is possible. Furthermore, a maximum accumulated quantization error or a quantization error threshold may be established, for example 0.2 μs. During printing, the line timing that the encoder 110 of the recording medium 120 provides is measured and quantized according to the available set of quantized operating frequencies. The respective quantized operating frequency that is closest to the predetermined line timing may thereby be selected. Furthermore, the accumulated quantization error 302 may be updated on the basis of the respective line quantization error 301.

If the absolute value of the accumulated quantization error 302 reaches or exceeds the quantization error threshold, the quantization error 302 may be corrected or reduced, in particular at the next line signal 313, in that a different quantization level is selected for correction. If the absolute value of the accumulated quantization error 302 is negative, a lower operating frequency is chosen; if the absolute value of the quantization error 302 is positive, a higher operating frequency is chosen. This calculation of the quantized operating frequencies and/or of the corrected activation points in time 312 may be implemented at a controller 101 of the printing device 100, at the activation electronics of a print head 103, and/or at an FPGA of the encoder 110.

FIG. 4 shows a workflow diagram of an example of a method 400 for operating at least one print head 103 that is designed to print lines of a print image line by line on a recording medium 120. It is thereby noted that the line printed by a print head 103 may be part of a complete line of the print image.

For the printing of a current line from a sequence of successive lines of the print image, the method 400 includes the detection 401 of a line signal 313 or line timing depending on the transport velocity of the recording medium 120. The line signal 313 may be generated by a transducer 110. The time period between two directly successive line signals 313 may thereby correspond to the desired pitch (distance, spacing) between two directly successive lines of the print image on the recording medium 120.

A line signal 313 detected for the printing of the current line may indicate the line signal point in time 311 for printing of the current line, wherein the line signal point in time 311 may be the point in time at which the current line should be printed by the print head 103 on the recording medium 120 in order to produce the desired pitch between two lines of the print image on the recording medium 120. The line signal point in time 311 may differ from the point in time of the line signal 313, for example by a time difference that corresponds to one or more lines. Via such a time buffer, it may be enabled to flexibly shift the line signal point in time 311 chronologically forward or chronologically backward in order to increase or reduce the effective operating frequency of the print head 103. The effective operating frequency may thereby correspond to the reciprocal of the duration between the activation points in time 312 for the printing of two directly successive points in time.

The method 400 also includes the determination 402 of an activation point in time 312, also referred to in this document as the corrected point in time, for printing of the current line on the basis of the line signal point in time 311. The line signal point in time 311 for printing the current line may thereby be shifted chronologically forward or chronologically backward in order to determine the activation point in time 312. The extent of the time shift may depend on a set of possible quantized operating frequencies of the print head 103 and/or on an accumulated quantization error 302 produced upon printing of one or more preceding lines. In particular, the activation point in time 312 may be shifted relative to the line signal point in time 311 such that the effective operating frequency of the print head 103 for the printing of the current line corresponds to a quantized operating frequency from the set of possible quantized operating frequencies. Furthermore, the activation point in time 312 may be shifted relative to the line signal point in time 311 such that the absolute value of the accumulated quantization error 302 that is produced by the shift is increased as little as possible, or is reduced as starkly as possible, in particular given consideration of the set of possible quantized operating frequencies.

Furthermore, the method 400 may include producing 403 the effect that the print head 103 prints the current line at the activation point in time 312. As has already been presented above, the current line printed by the print head 103 may correspond to a portion of a total line of the print image to be printed. A high print quality without significant registration error may be produced via the described method 400.

In this document, a controller 101 is thus described for at least one print head 103, wherein the print head 103 is designed to print lines of a print image line by line on a recording medium 120. The recording medium 120 may thereby be moved with a defined transport velocity relative to the (possibly stationary) print head 103.

For the printing of a current line from a sequence of directly successive lines, the controller 101 may be configured to detect a line signal 313 depending on the transport velocity of the recording medium 120, which line signal 313 indicates a line signal point in time 311 for printing of the current line. The line signal 313 may be received by a transducer 110, in particular by an encoder, wherein the transducer 110 is designed to generate line signals 313 for the printing of different lines of the print image depending on the movement of the recording medium 120 relative to the print head 103, in particular depending on the transport velocity of the recording medium 120.

The controller 101 is also configured to determine, on the basis of the line signal point in time 311, an activation point in time 312 for printing the current line. The activation point in time 312 may thereby be the point in time at which the current line is actually printed, whereas the line signal point in time 311 may be the point in time at which the current line should be printed in order to conform to the line pitch desired due to the dot resolution of the print image. The controller 101 may be configured to shift the activation point in time 312 relative to the predetermined line signal point in time 311 in order to produce an effective operating frequency of the print head 103 that is advantageous for said print head 103, in particular for the print quality of said print head 103. The effective operating frequency of the print head 103 may thereby be the operating frequency that results due to the duration between the activation points in time 312 that are actually used for the printing of two directly successive lines, meaning for the printing of the current line and for the printing of the directly preceding line.

The controller 101 may be configured to determine the activation point in time 312 for printing of the current line depending on a set of possible quantized operating frequencies of the print head 103. The set of possible quantized operating frequencies of the print head 103 may thereby cover an operating range of operating frequencies for a corresponding velocity range of possible transport velocities of the recording medium 120. In particular, a uniform coverage may thereby take place, and/or a constant quantization step between adjacent quantized operating frequencies may thereby be used. The velocity range may be a determined tolerance range around a target transport velocity, for example. If applicable, the velocity range may also be designed for printing with a velocity ramp, for example from a standstill up to the target transport velocity. A corresponding set of quantized operating frequencies of the print head 103 may then be provided. The set of quantized operating frequencies may be 50 or more, or 10 or more, or 20 or more, or 50 or more quantized operating frequencies, for example. For example, the set of quantized operating frequencies may include between 5 and 50 quantized operating frequencies.

The print head 103 is typically designed to be operated with one or more operating frequencies that are not part of the set of possible quantized operating frequencies. The set of quantized operating frequencies may thereby be such that, given a quantized operating frequency—in particular given all quantized operating frequencies—from the set of possible quantized operating frequencies, a higher print quality is produced, at least statistically, than given a different operating frequency of the print head 103 that is not part of the set of possible quantized operating frequencies. The set of quantized operating frequencies may have been determined in advance in order to produce a respective optimally high print quality of the print head 103.

The controller 101 may be configured to shift the activation point in time 312 relative to the line signal point in time 311 such that, for the print head 103, a quantized operating frequency from the set of possible quantized operating frequencies of the print head 103 effectively results for the printing of the current line. The effect may thus be produced that the current line may be printed with a high print quality.

The controller 101 may be configured to determine the activation point in time 312 for printing of the current line depending on an accumulated quantization error 302 produced upon printing of one or more preceding lines. The accumulated quantization error 302 may thereby indicate the accumulated time shift of the activation points in time 312 that was produced in the previous printing of the lines of the print image, under consideration of the algebraic sign of the respective time shift. The accumulated time shift may thereby correspond to an accumulated expansion or compression of the print image along the transport direction 1 of the recording medium 120, meaning in the column direction of the print image. The controller 101 may be configured to determine the activation point in time 312 for printing of the current line such that the accumulated quantization error 302 also does not exceed a determined, predefined quantization error threshold after printing the current line. The quantization error threshold may thereby depend on the quantization step between directly adjacent quantized operating frequencies of the set of possible quantized operating frequencies. A high registration precision of the print image may thus be produced.

The controller 101 may also be configured to have the effect that the print head 103 prints the current line at the activation point in time 312. For this purpose, an activation signal 314 may be sent to the print head 103.

A controller 101 for operation of the print head 103 is thus described that is designed to shift the activation points in time 312 of the print head 103 for printing different lines of a print image on a recording medium 120 relative to the line signal points in time 311, which are dependent on the transport velocity of the recording medium 120, such that the print head 103 is operated with quantized operating frequencies, if applicable different quantized operating frequencies, from the set of predefined quantized operating frequencies. The print quality of the print head 103 may thus be increased.

The reciprocal of the duration between the line signal point in time 311 for printing of the current line and the activation point in time 312 for printing of the directly preceding line may correspond to a line signal operating frequency of the print head 103 that, if applicable, does not correspond to any quantized operating frequency from the set of quantized operating frequencies.

The controller 101 may be configured to quantize the line signal operating frequency by means of the set of possible quantized operating frequencies of the print head 103 in order to determine a quantized operating frequency from the set of possible quantized operating frequencies of the print head 103 as a quantization of the line signal operating frequency. For example, the quantized operating frequency from the set of possible quantized operating frequencies may thereby be selected that is closest, or at least the second closest, to the line signal operating frequency, such that an optimally small line quantization error results for the current line.

In particular, the controller 101 may be configured to determine, for at least two different quantized operating frequencies, in particular for the two closest quantized operating frequencies from the set of possible quantized operating frequencies of the print head 103, the respective accumulated quantization error 302 that would result if the respective quantized operating frequency were used as a quantization of the line signal operating frequency. The quantized operating frequency may then be selected from the at least two different quantized operating frequencies for which the smaller, in particular the smallest, accumulated quantization error 302 results. The accumulated quantization error 302, and therefore a possible distortion of the print image in the column direction, may thus be reliably reduced or avoided.

The controller may be configured to determine the activation point in time 312 for printing of the current line on the basis of the determined quantized operating frequency. For this purpose, the quantized duration may be determined that corresponds to the reciprocal of the determined quantized operating frequency. The activation point in time 312 for printing of the current line may then correspond to the sum of the activation point in time 312 for printing of the directly preceding line plus the determined quantized duration. The activation point in time 312 may thus be especially efficiently and precisely determined.

As has already been presented above, the controller 101 may be configured to determine the activation point in time 312 for printing of the current line such that a specific quantized operating frequency from the set of possible quantized operating frequencies of the print head 103 upon printing of the current line at the determined activation point in time 312 for the print head 103. Alternatively or additionally, the controller 101 may be configured to determine the activation point in time 312 for printing of the current line such that the accumulated quantization error 302 produced by the printing of the current line at the determined activation point in time 312 is minimal, in particular in comparison to accumulated quantization errors 302 that would result if a different quantized operating frequency, in particular any other quantized operating frequency, from the set of possible quantized operating frequencies of the print head 103 were used as the determined quantized operating frequency of the print head 103. The print quality of the print head may thus be increased to a particular degree.

The controller 101 may be configured to shift the activation point in time 312 chronologically before the line signal point in time 311 if the accumulated quantization error 302 indicates that, in the printing of the one or more preceding lines, the print head 103 was operated with too low an operating frequency, averaged over time, and/or if the accumulated quantization error 302 is positive. The "too-low operating frequency" may thereby relate to the mean operating frequency that should be used given the present transport velocity of the recording medium 120 in order to achieve the desired dot resolution in the column direction.

Alternatively or additionally, the controller 101 may be configured to shift the activation point in time 312 chronologically after the line signal point in time 311, i.e. to delay it, if the accumulated quantization error 302 indicates that, in the printing of the one or more preceding lines, the print head 103 was operated with too high an operating frequency, averaged over time, in particular in relation to the transport velocity of the recording medium 120, and/or if the accumulated quantization error 302 is negative. The registration error of the print head 103 may thus be efficiently reduced or avoided.

For the printing of the sequence of successive lines, the controller 101 may be configured to respectively determine a line signal point in time 311 for the printing of a respective line—said line signal point in time 311 being dependent on the transport velocity of the recording medium 120—and, on the basis of the respective line signal point in time 311, to determine a respective activation point in time 312 for the printing of the respective line. The determination of the activation points in time 312 may thereby take place such that the magnitude of the accumulated quantization error 302 in the sequence of successive lines does not exceed the predefined quantization error threshold. A particularly high print quality of the print head 103 may thus be produced.

Furthermore, a printing device 100 having at least one print head 103 is described, wherein the printing device 100 comprises the controller 101 according to one or more exemplary embodiments.

Via the measures described in this document, the print quality of a printing device 100 may be increased and/or the extent of registration errors of a printing device 100 may be reduced. Furthermore, the operating stability of a printing device 100 may be increased.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general-purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
21, 22 nozzle
31, 32 column (of the print image)
100 printing device
110 transducer (encoder)
101 controller
102 print bar
103 print head
120 recording medium/substrate
140 print group
200 rotary encoder
201 encoder roller
202 disc

203 photodiode
205 slit
301 line quantization error
302 accumulated quantization error
311 line signal point in time
312 corrected point in time/activation point in time
313 line signal
314 activation signal
400 method for fixing a recording medium
401-403 method steps

The invention claimed is:

1. A controller for a print head that is adapted to print lines of a print image line by line onto a recording medium, wherein, for the printing of a current line, the controller is configured to:

detect a line signal indicative of a line signal point in time for printing the current line based on a transport velocity of the recording medium;

determine an activation point in time for printing the current line on the basis of the line signal point in time, depending on: a set of possible quantized operating frequencies of the print head, and an accumulated quantization error produced upon printing of one or more preceding lines; and control the print head to print the current line at the activation point in time.

2. The controller according to claim 1, wherein the controller is configured to shift the activation point in time relative to the line signal point in time such that, for the print head, a quantized operating frequency from the set of possible quantized operating frequencies of the print head results for the printing of the current line.

3. The controller according to claim 1, wherein:

a reciprocal of a duration between the line signal point in time for printing of the current line and the activation point in time for printing of a directly preceding line corresponds to a line signal operating frequency of the print head; and the controller is configured to:

quantize the line signal operating frequency using the set of possible quantized operating frequencies of the print head to determine a quantized operating frequency from the set of possible quantized operating frequencies of the print head as a quantization of the line signal operating frequency; and determine the activation point in time for printing of the current line based on the determined quantized operating frequency.

4. The controller according to claim 3, wherein the controller is configured to:

determine, for at least two different quantized operating frequencies from the set of possible quantized operating frequencies of the print head, a respective accumulated quantization error that would result if the respective quantized operating frequency were used as a quantization of the line signal operating frequency; and select, from the at least two different quantized operating frequencies, the quantized operating frequency that produces a smallest accumulated quantization error.

5. The controller according to claim 1, wherein the controller is configured to determine the activation point in time for printing of the current line, such that:

upon printing of the current line at the determined activation point in time, a determined quantized operating frequency from the set of possible quantized operating frequencies of the print head is produced for the print head; and/or the accumulated quantization error produced by the printing of the current line at the determined activation point in time is minimal, in comparison to accumulated quantization errors resulting from a different quantized operating frequency from the set of possible quantized operating frequencies of the print head being used as the determined quantized operating frequency.

6. The controller according to claim 1, wherein the controller is configured to:

shift the activation point in time chronologically before the line signal point in time in response to the accumulated quantization error indicating that, in the printing of the one or more preceding lines, the print head was operated with an insufficient operating frequency, averaged over time, in relation to the transport velocity of the recording medium, and/or in response to the accumulated quantization error being positive; and/or shift the activation point in time chronologically after the line signal point in time in response to the accumulated quantization error indicating that, in the printing of the one or more preceding lines, the print head was operated with an excessive operating frequency, averaged over time, in relation to the transport velocity of the recording medium, and/or in response to the accumulated quantization error being negative.

7. The controller according to claim 1, wherein:

for the printing of a sequence of successive lines, the controller is configured to:

respectively determine a line signal point in time for the printing of a respective line, the line signal point in time being dependent on the transport velocity of the recording medium; and based on the respective line signal point in time, determine a respective activation point in time for the printing of the respective line;

the magnitude of the accumulated quantization error in a sequence of successive lines does not exceed a predefined quantization error threshold; and the quantization error threshold depends on a quantization step between adjacent quantized operating frequencies from the set of possible quantized operating frequencies.

8. The controller according to claim 1, wherein:

the set of possible quantized operating frequencies of the print head covers an operating range of operating frequencies for a corresponding velocity range of possible transport velocities of the recording medium, uniformly and/or with a constant quantization step;

given a quantized operating frequency from the set of possible quantized operating frequencies, an at least statistically higher print quality is produced than given a different operating frequency of the print head that is not part of the set of possible quantized operating frequencies; and/or the print head is configured to be operated with one or more operating frequencies that are not part of the set of possible quantized operating frequencies.

9. The controller according to claim 1, wherein the controller is configured to receive the line signal from a transducer configured to generate line signals for the printing of different lines of the print image depending on a movement of the recording medium relative to the print head.

10. A method for operating a print head that is adapted to print lines of a print image line by line on a recording medium, wherein, for the printing of a current line, the method comprising:

detecting a line signal indicative of a line signal point in time for printing of the current line based on a transport velocity of the recording medium;

determining an activation point in time for printing of the current line on the basis of the line signal point in time, depending on: a set of possible quantized operating frequencies of the print head, and an accumulated quantization error produced in the printing of one or more preceding lines; and controlling the print head to print the current line at the activation point in time.

11. A non-transitory computer-readable storage medium with an executable program stored thereon, that when executed, instructs a processor to perform the method of claim 10.

12. A controller comprising:

a memory that stores instructions; and a processor that is configured to execute the instructions to perform the method of claim 10.

* * * * *